US009340406B2

(12) United States Patent
Aguilar

(10) Patent No.: US 9,340,406 B2
(45) Date of Patent: May 17, 2016

(54) SADDLE

(71) Applicant: Arien Aguilar, Brenham, TX (US)

(72) Inventor: Arien Aguilar, Brenham, TX (US)

( * ) Notice: Subject to any disclaimer, the term of this patent is extended or adjusted under 35 U.S.C. 154(b) by 0 days.

(21) Appl. No.: 14/701,906

(22) Filed: May 1, 2015

(65) Prior Publication Data

US 2015/0232322 A1 Aug. 20, 2015

(51) Int. Cl.

*B68C 1/04* (2006.01)
*B68C 1/02* (2006.01)
*B68C 1/00* (2006.01)

(52) U.S. Cl.

CPC . *B68C 1/025* (2013.01); *B68C 1/00* (2013.01); *B68C 1/04* (2013.01); *B68C 2001/042* (2013.01)

(58) Field of Classification Search

CPC ..... B68C 1/02; B68C 1/025; B68C 1/04; B68C 2001/042; B68C 2001/046

See application file for complete search history.

(56) References Cited

U.S. PATENT DOCUMENTS

| | | | | |
|---|---|---|---|---|
| 1,213,329 | A | 1/1917 | Beal | |
| 4,860,524 | A * | 8/1989 | Dumoulin et al. | 54/44.7 |
| 5,435,116 | A | 7/1995 | Brown | |
| 5,884,459 | A | 3/1999 | Biddlecome | |
| 8,261,520 | B2 * | 9/2012 | Revheim et al. | 54/44.3 |
| 2010/0229507 | A1 * | 9/2010 | Strauss et al. | 54/44.3 |
| 2013/0192177 | A1 * | 8/2013 | Strauss et al. | 54/44.3 |
| 2013/0269300 | A1 | 10/2013 | Konzet | |
| 2015/0047302 | A1 * | 2/2015 | Merlin et al. | 54/44.3 |

FOREIGN PATENT DOCUMENTS

| | | | | |
|---|---|---|---|---|
| CA | 2439875 | * | 9/2002 | B68C 1/02 |
| EP | 0328376 | * | 8/1989 | B68C 1/04 |
| GB | 191026756 | * | 0/1911 | B68C 3/00 |

OTHER PUBLICATIONS

Website—American-Flex Saddle http://www.american-saddles.de (last visited Jan. 30, 2015).

* cited by examiner

*Primary Examiner* — Kathleen Alker

(74) *Attorney, Agent, or Firm* — Texas A&M University School of Law—IP and Technology Law Clinic

(57) ABSTRACT

In one example, a saddle for an animal contains a tree assembly. The tree assembly includes a center support intended to run substantially parallel to an animal's spine when the saddle is in use, a first hinge associated with a first end of the center support that defines a first axis, the first axis being perpendicular to a first portion of the center support, and a first transverse support associated with the first hinge configured to rotate around the first axis.

17 Claims, 7 Drawing Sheets

SADDLE

BACKGROUND

1. Technical Field

The present application relates to a saddle for an animal.

2. Description of Related Art

A saddle is a supportive structure for a rider or other load, fastened to an animal's back by a girth. The most common type of saddle is the equestrian saddle designed for a horse. A saddle typically includes a base on which the rest of the saddle is built, this is called the tree. In one conventional saddle configuration, the tree is made out of a rigid material such as wood; however, this saddle configuration does not allow the saddle to flex with the movement of the horse. In another conventional saddle configuration, the tree is made out of a flexible material such as rubber; however, this saddle configuration allows the front and aft portions of the saddle to raise, therefore causing the weight of the load to be placed on the spine of the animal. In yet another conventional saddle configuration, a saddle does not include a tree; however, this saddle configuration does not sufficiently redistribute the weight of the load over the surface of the animal's back. These conventional saddle configurations may result in bruising, the development of sores, the pinching of withers, and other painful conditions. These conditions may cause the animal to not move freely and correctly, the animal's endurance to be reduced, pressure points that cause the animal's muscles to atrophy, or a harmful mental impact on the animal. Hence, there is a need for an improved saddle configuration.

DESCRIPTION OF THE DRAWINGS

The novel features believed characteristic of the system of the present application are set forth in the appended claims. However, the system itself, as well as a preferred mode of use, and further objectives and advantages thereof, will best be understood by reference to the following detailed description when read in conjunction with the accompanying drawings, wherein:

DESCRIPTION OF THE PREFERRED EMBODIMENT

Illustrative embodiments of the apparatus and method of the present application are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 1:
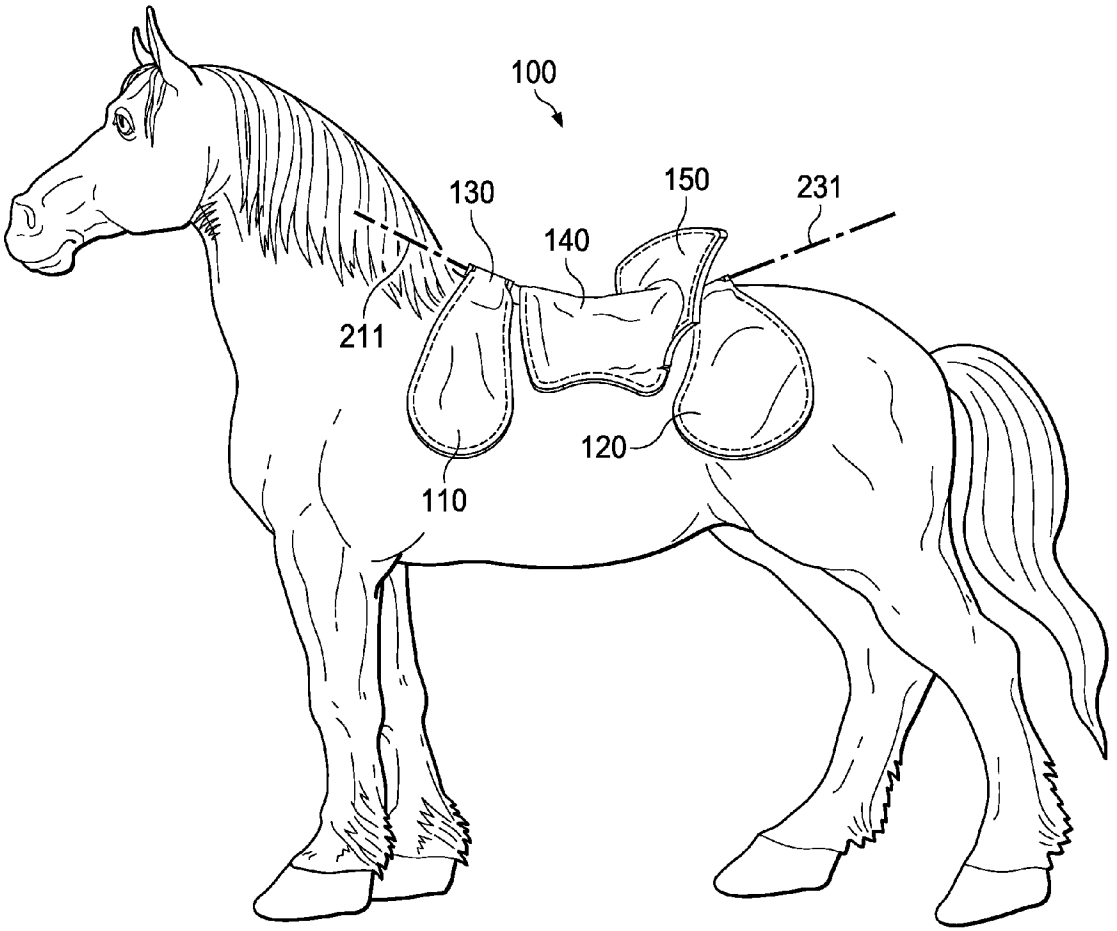
FIG. 1 is a side perspective view of a saddle on a horse's back, according to one example embodiment.
Figure 2:
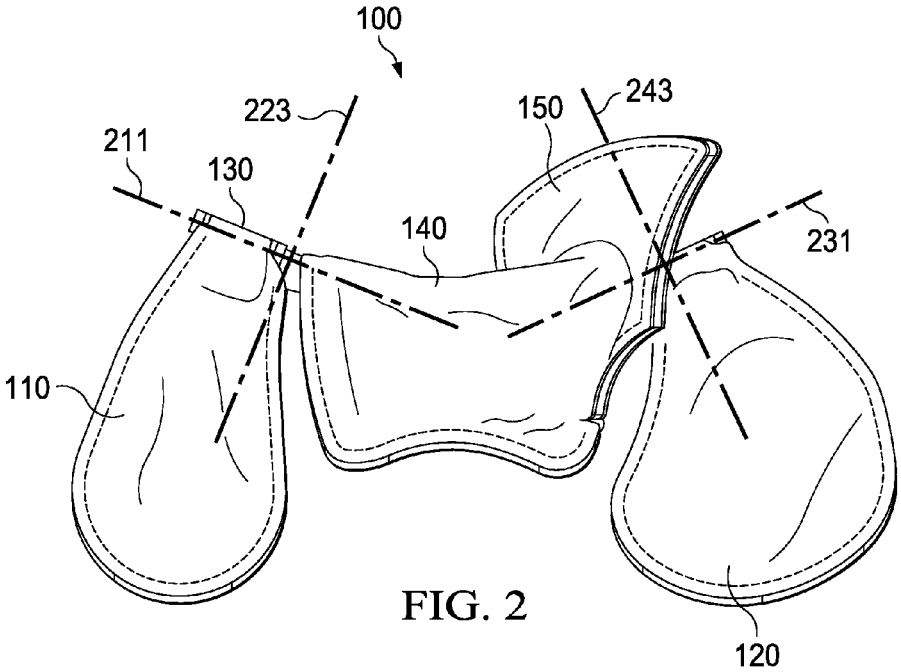
FIG. 2 is a side perspective view of a saddle, according to one example embodiment.

Referring now to FIGS. 1 and 2 in the drawings, a configuration for a saddle 100 is illustrated. Saddle 100 is a device that is fastened to an animal's back and can be suitable for supporting a rider or other load. Saddle 100 can be fastened to an animal's back by a girth. Saddle 100 may include a pair of front panels 110, a pair of aft panels 120, pommel 130, seat 140, and cantle 150. It should be understood that front panels 110 are mirror images with respect to each other, and aft panels 120 are mirror images with respect to each other.

It should be appreciated that saddle 100 is merely illustrative of a wide variety of possible implementations. Further, even though saddle 100 is particularly well suited for horses, saddle 100 may be implemented for use on other animals, such as mules or donkeys.

Figure 3:
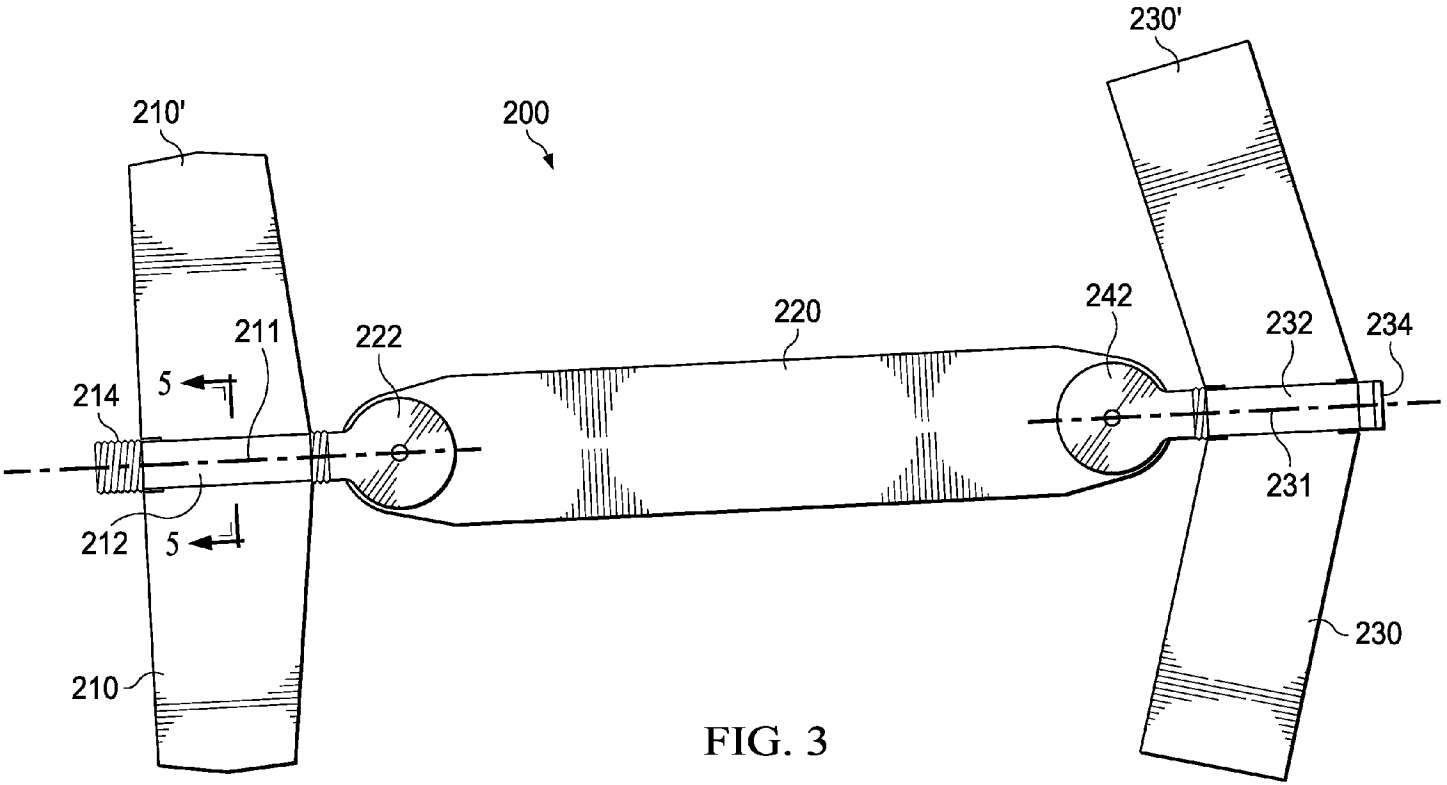
FIG. 3 is a top perspective view of a tree assembly for a saddle, according to one example embodiment.
Figure 4:
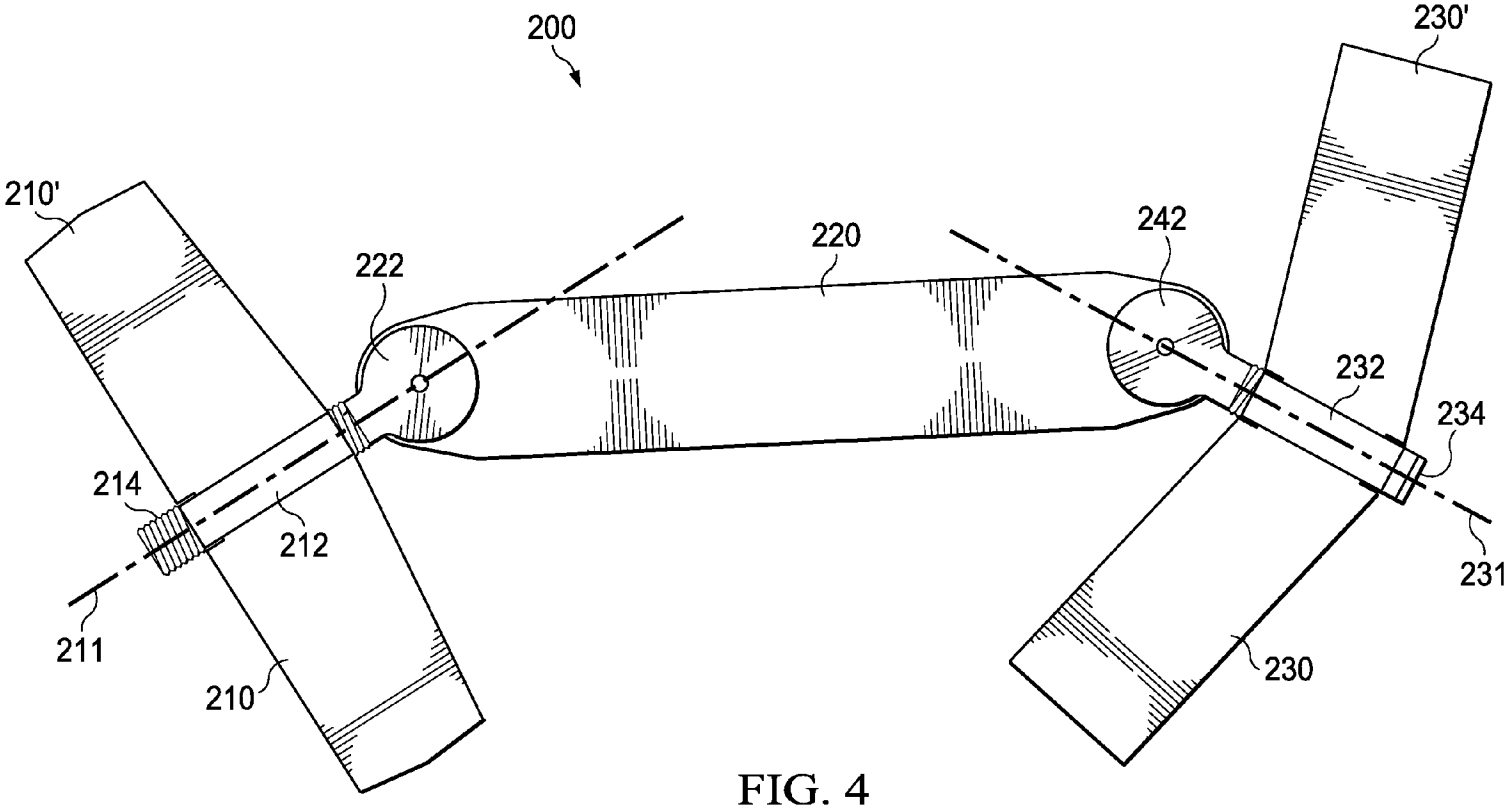
FIG. 4 is a top perspective view of a tree assembly for a saddle, according to one example embodiment.

Now referring to FIGS. 3 and 4, saddle 100 can include a tree assembly 200. Tree assembly 200 can include front transverse supports 210 and 210', a center support 220, and aft transverse supports 230 and 230'. It should be understood that front supports 210 and 210' are mirror images with respect to each other, and aft supports 230 and 230' are mirror images with respect to each other; therefore, anything described in regards to front support 210 applies to 210', and anything described in regards to aft support 230 applies to 230'.

Front support 210, center support 220, and aft support 230 may be fabricated out of any suitable material. For example, front support 210, center support 220, and aft support 230 may be cast, forged, or machined out of a suitable metal such as aluminum or steel. In another example, front support 210, center support 220, and aft support 230 may be manufactured out of a suitable material such as wood, plastic, or a composite such as carbon-fiber-reinforced polymer or fiberglass. Front support 210, center support 220, and aft support 230 can each be fabricated out of different materials.

Figure 5:
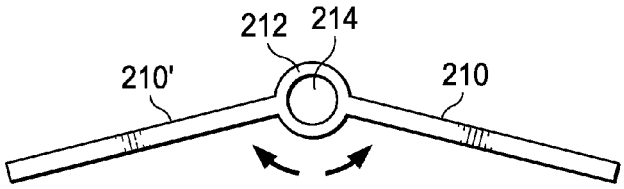
FIG. 5 is a cross-section view of a portion of a tree assembly for a saddle, according to one example embodiment.

As best seen in FIG. 5, front support 210 can be coupled to front support 210' at a specified angle depending on the size and shape of the animal's shoulders, which will be explained in greater detail below. In another example embodiment, front supports 210 and 210' join together to form a single structure and an opening that allows pin 214 to be disposed within. Front supports 210 and 210' may be configured to rotate in relation to pin 214. Front pin 214 may define axis 211 which bisects front pin 214. Axis 211 can run parallel to a portion of the animal's back that front pin 214 is intended to reside over. Accordingly, front supports 210 and 210' may be configured to rotate around axis 211.

Similarly to front supports 210 and 210', aft support 230 may be coupled to aft support 230' at a specified angle, depending on the size and shape of the animal's hips, which will be explained in greater detail below. In another example embodiment, aft supports 230 and 230' join together to form a single structure and form an opening that allows pin 234 to be disposed within. Aft supports 230 and 230' may configured to rotate in relation to aft pin 234. Aft pin 234 may define axis 231 which bisects aft pin 234. Axis 231 may run parallel to a portion of the animal's back that pin 234 is intended to reside over. Accordingly, aft supports 230 and 230' may be configured to rotate around axis 231.

Figure 6:
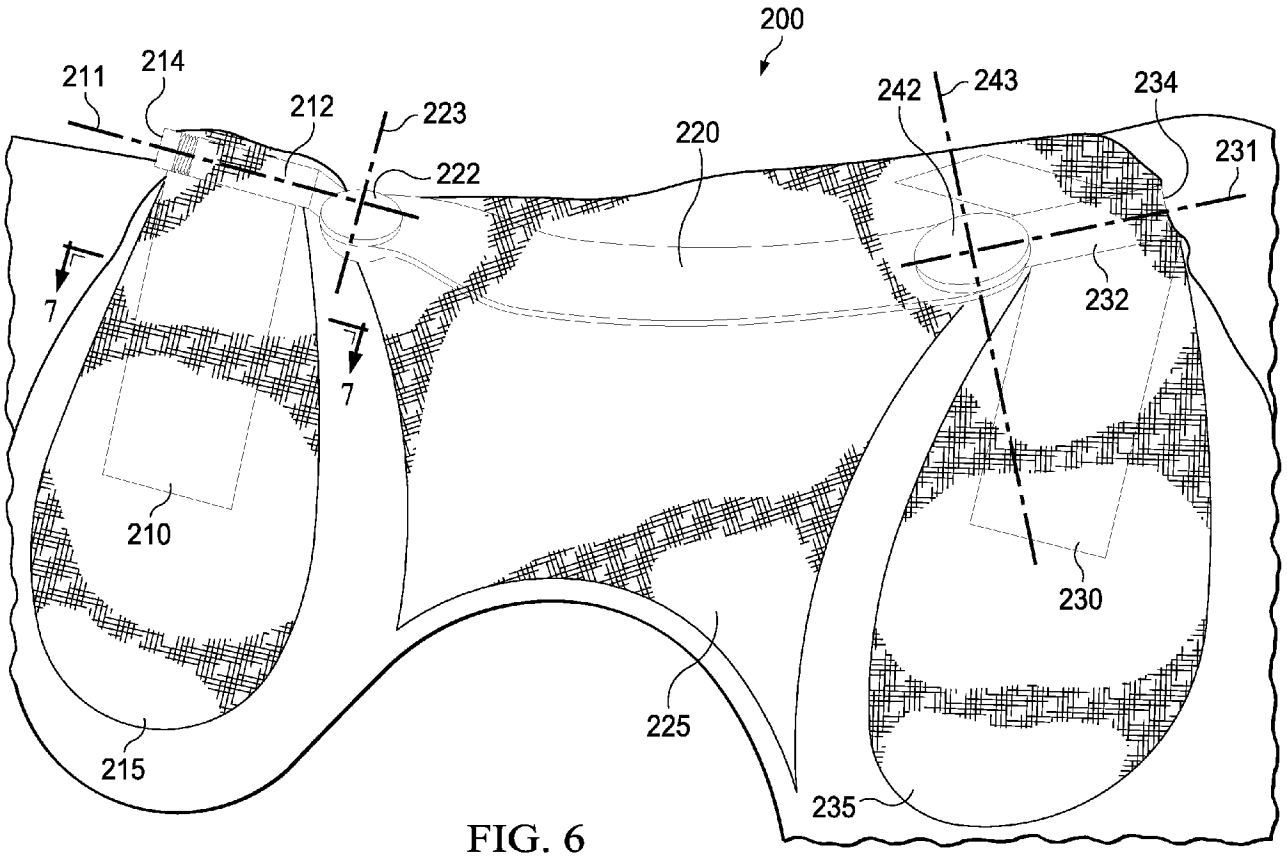
FIG. 6 is a perspective side view of a tree assembly for a saddle, according to one example embodiment.

Front supports 210 and 210' and aft supports 230 and 230' may be coupled to center support 220. Center support 220 may configured to run substantially parallel to the animal's back while the saddle is in use. As best seen in FIG. 6, tree assembly 200 may include a hinge 222 that defines axis 223 and couples front supports 210 and 210' to center support 220. Hinge 222 may allow front supports 210 and 210' to be rotatable around axis 223. Axis 223 may be configured to be perpendicular to the portion of the animal's back that hinge 222 is intended to be over. In some examples, axis 223 may be perpendicular to a forward portion of center support 220. Tree assembly 200 may include a hinge 242 that defines axis 243 that couples aft supports 230 and 230' to center support 220. Hinge 242 may allow aft supports 230 and 230' to be rotatable around axis 243. Axis 243 may be configured to be perpendicular to the portion of the animal's back that hinge 242 is intended to be over. In some examples, axis 243 may be perpendicular to an aft end of center support 220.

Now referring to FIG. 6, tree assembly 200 may include shape members 215, 225, and 235. Shape members 215, 225, and 235 may be manufactured out of any suitable material such as fiberglass, carbon-fiber-reinforced polymer, or plastic. Shape member 215 may be located on top and/or bottom of front supports 210 and 210' and can be configured to conform to the shape of the animal's body.

Figure 7:
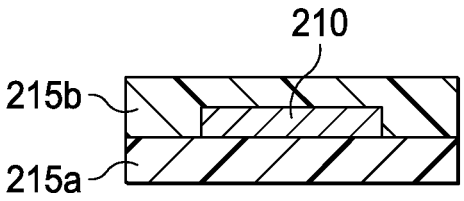
FIG. 7 is a cross-section view of a tree assembly for a saddle, according to one example embodiment.

In one example embodiment, which is shown in FIG. 7, a bottom portion of shape member 215, bottom shape member 215*a*, is made of plastic and is located underneath front support 210. A top portion of shape member 215, top shape member 215*b*, is made of a composite material and is located on top of both shape member 215*a* and front support 210.

Similarly to shape member 215, shape member 225 may be located on top and/or bottom of center support 220, and shape member 235 may be located on top and/or bottom of aft supports 230 and 230'. Additionally, shape member 215 may be the same piece as front supports 210 and 210', shape member 225 may be the same piece as center support 220, and shape member 235 may be the same piece as aft supports 230 and 230'.

In order to provide additional comfort for the rider and/or the animal, saddle 100 may include padding and may be wrapped in leather, as best seen in FIGS. 1 and 2. For example, front supports 210 and 210', shape member 215, front pin 214, and hinge 212 may be disposed within padding and wrapped in leather to form front panels 110 and pommel 130. Center support 220, hinge 222, and hinge 242 may be disposed within padding and wrapped in leather to form seat 140 and cantle 150. Aft supports 230 and 230', hinge 232, aft pin 234, and shape member 235 may be disposed within padding and wrapped in leather to form aft panels 120.

In one example, saddle 100 is fastened to the back of a horse and a rider sits on seat 140. The weight of the rider can be primarily distributed to front panels 110, and aft panels 120. The weight that is distributed to front panels 110 can then be distributed to the horse's shoulders. The weight that is distributed to aft panels 120 can then be distributed to the horse's hips.

Figure 8:
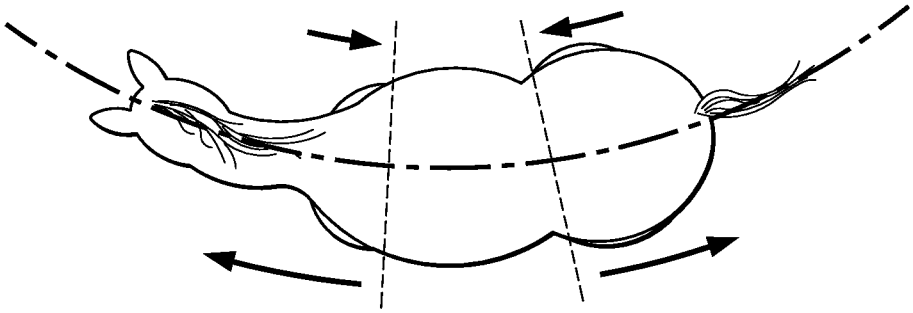
FIG. 8 is a top view of a horse turning to the right, according to one example embodiment.

As the horse moves, the shape of the horse's shoulders, back, and hips may change shape and position. For example, as best seen in FIG. 8, as a horse turns to the right, the horse's right shoulder and right hip become closer together; conversely, the horse's left shoulder and left hip become further apart. Additionally, when the front left leg moves forward, the muscles on the left shoulder move down, while the muscles on the right shoulder go up. Also, when the rear left leg moves forward, the surrounding muscles on the left hip move up, while the muscles on the right hip go down.

Therefore, saddle 100 may be configured to move with the horse's movement. For example, as the horse turns to the right, front panels 110 may rotate clockwise in relation to seat 140; aft panels 120 may rotate counter-clockwise in relation to seat 140. More specifically, front supports 210 and 210', front pin 214, and shape member 215 may rotate clockwise around axis 223 while aft supports 230 and 230', aft pin 234, and shape member 235 may rotate counter-clockwise around axis 243.

Figure 9:
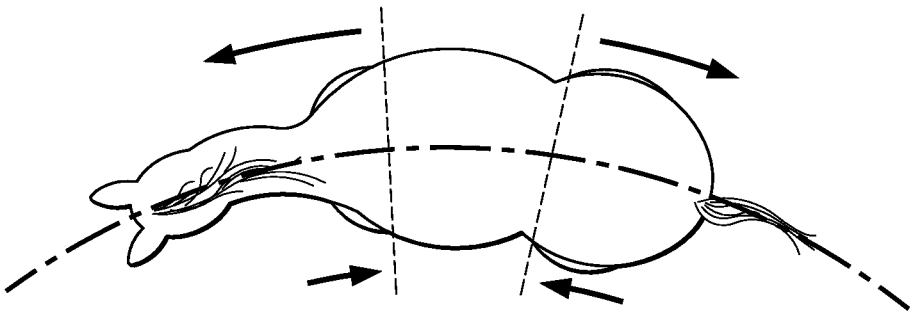
FIG. 9 is a top view of a horse turning to the left, according to one example embodiment.
Figure 10:
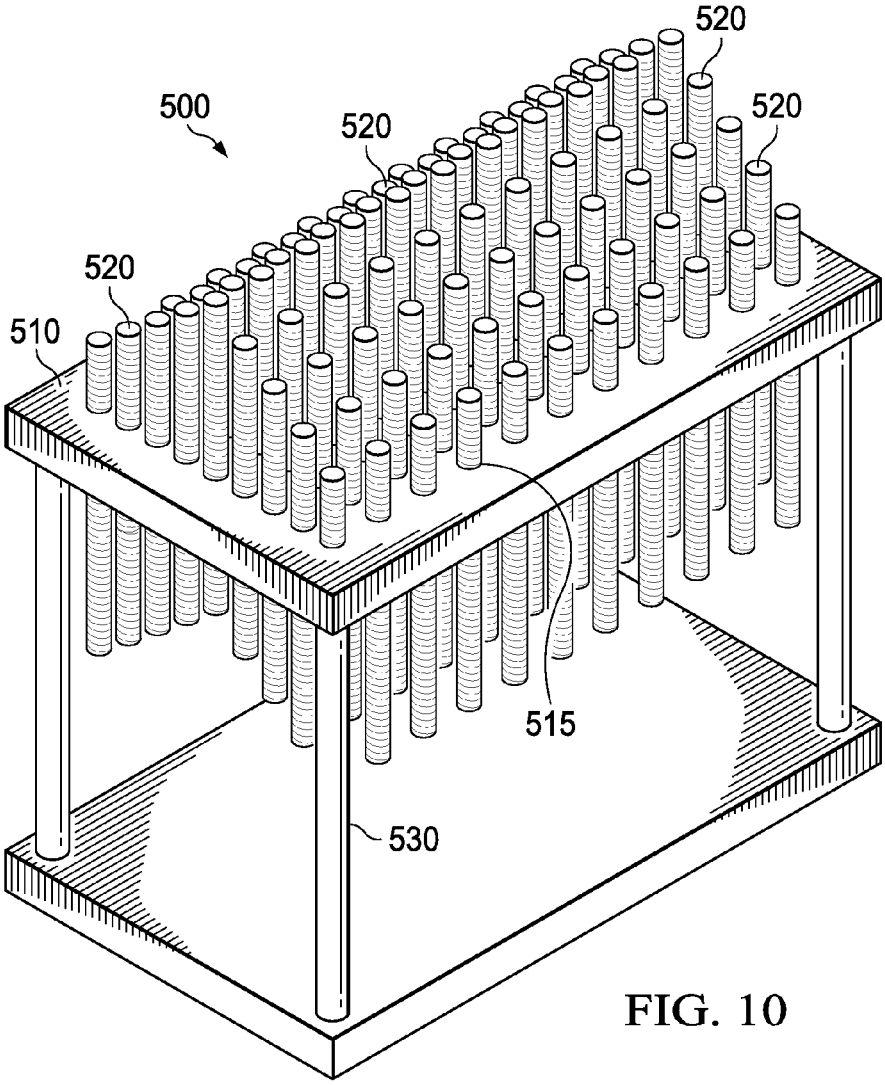
FIG. 10 is a perspective view of a tool used to make a tree assembly for a saddle, according to one example embodiment.

Conversely, as best seen in FIG. 9, as the horse turns to the left, front panels 110 may rotate counter-clockwise in relation to seat 140; aft panels 120 may rotate clockwise in relation to seat 140. More specifically, front supports 210 and 210', front pin 214, and shape member 215 may rotate counter-clockwise around axis 223 while aft supports 230 and 230', aft pin 234, and shape member 235 may rotate clockwise around axis 243.

Also, when the horse's left shoulder moves down and the right shoulder moves up, front panels 110 may rotate clockwise in relation to axis 211, when looking from the front. When the horse's left hip moved down and the right hip moves up, aft panels 120 may rotate clockwise in relation to axis 231, when looking from the front.

Each horse's back may have a unique shape and size. For example, there may be a large variance between the size and shape of each horse's withers, shoulders, loins, and hips. There are several known methods of determining the surface contours of an animal's back. One known method is disclosed in U.S. Publication No. 2012/0017547, which is hereby incorporated by reference. Once the surface contours of the horse's back are determined, saddle 100 may be manufactured to a specific shape to fit the horse's back.

One method of manufacturing saddle 100 to a specific shape to fit a specific horse's back is to use tool 500. Tool 500 may include top 510, a plurality of holes 515, a plurality of rods 520, and one or more legs 530. Top 510 may be a flat surface that can be manufactured out of a suitable material such as wood, plastic, or a metal such as aluminum or steel. Top 510 can include a plurality of holes 515 that are configured to allow a rod 520 to be disposed within each hole 515. Rod 520 may be manufactured out of a suitable material such as wood, plastic, or a metal such as aluminum or steel. Tool 500 may also include one or more legs 530 configured to elevate and support top 510.

Figure 11:
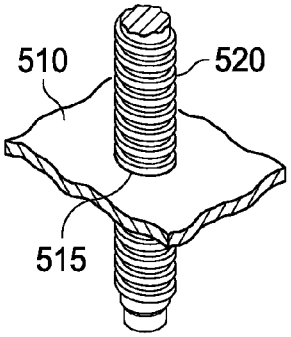
FIG. 11 is a perspective view of a portion of a tool used to make a tree assembly for a saddle, according to one example embodiment.
Figure 12:
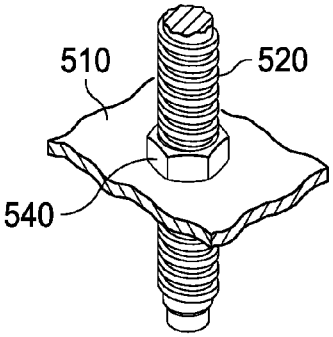
FIG. 12 is a perspective view of a portion of a tool used to make a tree assembly for a saddle, according to one example embodiment.

Tool 500 can be configured so that the height of each rod 520 may be independently adjusted in relation to top 510. Several different methods may be used to adjust the height of each rod 520. Now referring to FIG. 11, one method may be to include a threaded surface on each rod 520. Each hole 515 may also include a corresponding thread on the interior wall of hole 515. In another example, as seen in FIG. 12, tool 500 may include a threaded nut 540. In these examples, the height of each rod 520 may be adjusted by twisting each rod 520 so that each rod is at a preferred height.

Other methods of adjusting the height of each rod 520 is contemplated. For example, the height of each rod 520 may be adjusted and made stationary by the use of clamps on each rod 520. Another example may be that the height of each rod 520 may be adjusted and made stationary by the use of stackable bricks under each rod 520. Another example may be that the height of each rod 520 may be adjusted and made stationary by the use of adjustable actuators under each rod 520. And yet another example may be that each rod 520 is pressure fitted into each hole 515 so that friction holds each rod 520 in place.

Once each rod 520 is adjusted to the preferred position, a flexible mold may be placed on top of the rods 520. The flexible mold of tool 500 may be an apparatus that can be configured to shape one or more components of tree assembly 200. The mold of tool 500 may be made out of a flexible material, such as elastomer or rubber, so that the mold conforms to the collective shape of rods 520.

In one example embodiment, the flexible mold of tool 500 allows at least one component of tree assembly 200 to be formed by injection molding. For example, a bottom portion of shape members 215, 225, and 235 may be collectively formed by injecting liquid plastic into the flexible mold. Once the liquid plastic cures and hardens, the plastic can be removed from the mold and the remaining components of tree assembly 200 may be placed on top of shape members 215, 225, and 235. Since shape members 215, 225, and 235 were collectively formed, the shape members 215, 225, and 235 can be separated by machining portions out, in between the three sections.

In another example embodiment, the flexible mold of tool 500 allows at least one component of tree assembly 200 to be formed by 'laying up' composite material onto the flexible mold. For example, a bottom portion of shape members 215, 225, and 235 may be collectively formed by placing peel ply release film onto the flexible mold, placing the composite material and the resin on top of the peel ply release film, and allowing the resin to cure. Once the resin in the composite material cures, the component can be removed from the flexible mold and the remaining components of tree assembly may be installed on top of shape members 215, 225, and 235. Since shape members 215, 225, and 235 were collectively formed, the shape members 215, 225, and 235 can be separated by machining portions out, in between the three sections.

As stated, portions of tree assembly 200, such as front support 210, center support 220, and aft support 230, may be disposed under, over, or within shape members 215, 225, and 235. Therefore, portions of tree assembly 200, such as front support 210, center support 220, and aft support 230, may be placed on the flexible mold of tool 500 before or after a portion of shape members 215, 225, and 235 are placed on top of tool 500. If the components of tree assembly 200 are made out of materials such as fiberglass, carbon-fiber-reinforced polymer, or plastic, tree assembly 200 may require curing. Therefore, tree assembly 200 may need to remain on tool 500 until the components have sufficiently cured. After tree assembly 200 is removed from tool 500, padding and a wrapping, such as leather, may be attached to tree assembly 200 to complete saddle 100.

After saddle 100 is manufactured, it may be preferred to make adjustments to the shape of saddle 100. Adjustments to the shape of saddle 100 may be preferred because the shape of a horse's back, hips, and shoulders can change over time due to the horse's condition, age, and training. For example, the horse's back muscles and/or the underlying skeletal structure may change shape over time. Thus, a method of adjusting the shape of saddle 100 may be needed. One method of making adjustments may be to use shims that are configured to compensate for changes in the shape of the horse's back, hips, and shoulders. The shim may be made out of a padding material, such as rubber or polyester fiberfill, and may be wrapped in a smooth material such as leather. One or more shims may be strategically placed on the underside of saddle 100 to accommodate the shape of the horse's back, hips, and shoulders. One way of attaching the shims to the underside of saddle 100 can be to use a hook and loop fastener such as VELCRO brand fastener. Another way of attaching the shims to the underside of saddle 100 can be to use an adhesive.

The particular embodiments disclosed above are illustrative only, as the system may be modified and practiced in different but equivalent manners apparent to those skilled in the art having the benefit of the teachings herein. Modifications, additions, or omissions may be made to the apparatuses described herein without departing from the scope of the invention. The components of the system may be integrated or separated. Moreover, the operations of the system may be performed by more, fewer, or other components.

Furthermore, no limitations are intended to the details of construction or design herein shown, other than as described in the claims below. It is therefore evident that the particular embodiments disclosed above may be altered or modified and all such variations are considered within the scope and spirit of the application. Accordingly, the protection sought herein is as set forth in the claims below.

The invention claimed is:

1. A saddle for an animal, the saddle comprising:

a tree assembly, comprising:

a center support having a length configured to extend, from a first end of the center support to a second end of the center support, along a direction substantially parallel to the animal's spine when the saddle is in use;

a first hinge positioned at the first end of the center support and defining a first axis perpendicular to the first end of the center support;

first transverse supports coupled to the first hinge positioned at the first end of the center support, wherein the first transverse supports are configured to rotate with respect to the first axis;

a second hinge positioned at the second end of the center support and defining a second axis perpendicular to the second end of the center support; and second transverse supports coupled to the second hinge positioned at the second end of the center support, wherein the second transverse supports are configured to rotate with respect to the second axis, wherein the second transverse supports are configured to rotate with respect to a third axis, wherein the third axis is substantially parallel to at least a portion of the animal's back when the saddle is in use.

2. The saddle of claim 1, wherein the first transverse supports are configured to rotate with respect to a fourth axis, wherein the fourth axis is substantially parallel to at least a portion of the animal's back when the saddle is in use.

3. The saddle of claim 1, wherein the first transverse supports are configured to be placed on the animal's shoulders so as to follow the movement of the animal's shoulders when the saddle is in use.

4. The saddle of claim 1, wherein the second transverse supports are configured to be placed on the animal's hips so as to follow the movement of the animal's hips when the saddle is in use.

5. The saddle of claim 1, wherein the tree assembly further comprises:

a shape member attached to the first transverse supports, wherein the shape member is configured to conform to the shape of the animal's body when the saddle is in use, and wherein the shape member comprises a material selected from the group consisting of: plastic, carbon-fiber composite, and fiberglass.

6. The saddle of claim 1, wherein a top portion of the center support is configured to support a rider when the saddle is in use.

7. The saddle of claim 1, wherein the saddle is in use when the saddle is positioned on the animal's back.

8. A saddle for an animal, the saddle comprising:

a tree assembly, comprising:

a center support having a length configured to extend, from a first end of the center support to a second end of the center support, along a direction substantially parallel to the animal's spine when the saddle is in use;

a first hinge that defines a first axis that is substantially parallel to a first portion of the animal's back when the saddle is in use;

first transverse supports connected by the first hinge and configured to rotate with respect to the first axis;

a second hinge positioned at the first end of the center support and configured to connect the first transverse supports to the first end of the center support;

a third hinge that defines a third axis that is substantially parallel to at least a second portion of the animal's back when the saddle is in use; and second transverse supports connected by the third hinge and configured to rotate with respect to the third axis.

9. The saddle of claim 8, wherein the second hinge defines a second axis that is perpendicular to the first end of the center support, wherein the first transverse supports are configured to rotate with respect to the second axis.

10. The saddle of claim 8, wherein the tree assembly further comprises:

a fourth hinge positioned at the second end of the center support and configured to connect the second transverse supports to the second end of the center support, wherein the fourth hinge defines a fourth axis that is perpendicular to the second end of the center support, and wherein the second transverse supports are configured to rotate with respect to the fourth axis.

11. The saddle of claim 8, wherein the first transverse supports are configured to be placed on the animal's shoulders so as to follow the movement of the animal's shoulders when the saddle is in use.

12. The saddle of claim 8, wherein the second transverse supports are configured to be placed on the animal's hips so as to follow the movement of the animal's hips when the saddle is in use.

13. The saddle of claim 8, wherein the tree assembly further comprises:

a shape member attached to the first transverse supports, wherein the shape member is configured to conform to the shape of the animal's body when the saddle is in use, and wherein the shape member comprises a material selected from the group consisting of: plastic, carbon-fiber composite, and fiberglass.

14. The saddle of claim 8, wherein a top portion of the center support is configured to support a rider when the saddle is in use.

15. The saddle of claim 8, wherein the saddle is in use when the saddle is positioned on the animal's back.

16. A saddle for an animal, the saddle comprising:

a tree assembly, comprising:

a center support having a length configured to extend, from a first end of the center support to a second end of the center support, along a direction substantially parallel to the animal's spine when the saddle is positioned on the animal's back;

a first hinge positioned at the first end of the center support and defining a first axis perpendicular to the first end of the center support;

a second hinge positioned at the second end of the center support and defining a second axis perpendicular to the second end of the center support;

a third hinge connected to the first hinge and configured to extend in a direction substantially parallel to a first portion of the animal's back when the saddle is positioned on the animal's back;

a fourth hinge connected to the second hinge and configured to extend in a direction substantially parallel to a second portion of the animal's back when the saddle is positioned on the animal's back;

first transverse supports connected by the third hinge and configured to rotate with respect to the first axis and a third axis defined by the third hinge; and second transverse supports connected by the fourth hinge and configured to rotate with respect to the second axis and a fourth axis defined by the fourth hinge.

17. The saddle of claim 16, wherein the tree assembly further comprises a plurality of shape members configured to substantially conform to the shape of the animal's body, wherein a first shape member is attached to the first transverse support, a second shape member is attached to the center support, and a third shape member is attached to the second transverse support.

* * * * *